US010019026B2

(12) United States Patent
Ippolito et al.

(10) Patent No.: US 10,019,026 B2
(45) Date of Patent: Jul. 10, 2018

(54) CIRCUIT ARRANGEMENT FOR THE GENERATION OF A BANDGAP REFERENCE VOLTAGE

(71) Applicant: STMicroelectronics S.r.l., Agrate Brianza (IT)

(72) Inventors: Calogero Marco Ippolito, Aci Castello (IT); Mario Chiricosta, Tremestieri Etneo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 14/996,684

(22) Filed: Jan. 15, 2016

(65) Prior Publication Data

US 2016/0327972 A1 Nov. 10, 2016

(30) Foreign Application Priority Data

May 8, 2015 (IT) ..... 102015000014448

(51) Int. Cl.
*G05F 3/26* (2006.01)
*G05F 3/30* (2006.01)

(52) U.S. Cl.
CPC ..... *G05F 3/267* (2013.01); *G05F 3/30* (2013.01)

(58) Field of Classification Search
CPC ..... G05F 3/30
See application file for complete search history.

(56) References Cited

U.S. PATENT DOCUMENTS 5,144,223 A * 9/1992 Gillingham ..... G05F 3/30 323/281
5,307,007 A * 4/1994 Wu ..... G05F 3/26 323/313
5,485,074 A * 1/1996 Tomasini ..... G05F 3/26 323/312
7,071,767 B2 * 7/2006 Ou-yang ..... G05F 3/30 327/539
7,236,048 B1 * 6/2007 Holloway ..... G05F 3/30 327/512
9,588,539 B2 * 3/2017 Ye ..... G05F 3/30
(Continued)

FOREIGN PATENT DOCUMENTS

EP 0973200 A1 1/2000

OTHER PUBLICATIONS

K.E. Kujik, "A Precision Reference Voltage Source." IEEE Journal of Solid-State Vircuits, vol. 8, pp. 222-226, Jun. 1973.
(Continued)

*Primary Examiner* — Yusef A Ahmed
(74) *Attorney, Agent, or Firm* — Crowe & Dunlevy

(57) ABSTRACT

A circuit for generating a bandgap voltage includes a circuit module for generation of a base-emitter voltage difference, the circuit module including a pair of PNP bipolar substrate transistors which identify a first current path and a second current path. A first current mirror of an n type is connected between the first and second branches and is further connected via a resistance for adjustment of the bandgap voltage to the second bipolar transistor. A second current mirror of a p type is connected between the first and second branches, and connected so that the current mirrors repeat current of each other. In operation to generate the bandgap voltage, current flows from the supply voltage to ground only through said the first and second bipolar substrate transistors.

22 Claims, 11 Drawing Sheets

(56) References Cited

U.S. PATENT DOCUMENTS

2002/0093325 A1* 7/2002 Ju ..... G05F 3/30 323/316
2002/0140498 A1* 10/2002 Pernici ..... G05F 3/30 327/540
2003/0020535 A1* 1/2003 Young ..... G05F 3/267 327/538
2004/0062292 A1* 4/2004 Pennock ..... G01K 7/015 374/170
2004/0095186 A1 5/2004 Bernard
2005/0140428 A1* 6/2005 Tran ..... G05F 3/30 327/539
2006/0176086 A1* 8/2006 Reffay ..... G05F 3/245 327/83
2007/0030050 A1* 2/2007 Lee ..... G05F 3/30 327/513
2007/0040543 A1* 2/2007 Yeo ..... G05F 3/30 323/313
2007/0046364 A1* 3/2007 Yokoo ..... G05F 3/262 327/539
2007/0080741 A1* 4/2007 Yeo ..... G05F 3/30 327/539
2009/0302823 A1* 12/2009 Chao ..... G05F 3/30 323/313
2011/0199069 A1* 8/2011 Singnurkar ..... G05F 3/30 323/313
2013/0307517 A1* 11/2013 Huang ..... G05F 3/02 323/313
2014/0070873 A1* 3/2014 Gunther ..... G05F 3/242 327/512
2014/0103900 A1* 4/2014 Lahiri ..... G05F 3/24 323/313
2015/0293552 A1* 10/2015 Motozawa ..... G05F 3/30 323/313
2016/0026204 A1* 1/2016 de Cremoux ..... G05F 3/08 323/314
2016/0246317 A1* 8/2016 Song ..... G05F 1/575
2016/0274617 A1* 9/2016 Wadhwa ..... G05F 3/30

OTHER PUBLICATIONS

T.Brooks and A.L.Westwisk, "A low-Power Differential CMOS Bandgap Reference," ISSCC, Feb. 1994.
Italian Search Report and Written Opinion for IT 102015000014448 (UB2015A000102) dated Jan. 6, 2016 (9 pages).

* cited by examiner

CIRCUIT ARRANGEMENT FOR THE GENERATION OF A BANDGAP REFERENCE VOLTAGE

PRIORITY CLAIM

This application claims priority from Italian Application for Patent No. 102015000014448 filed May 8, 2015, the disclosure of which is incorporated by reference.

TECHNICAL FIELD

The present disclosure relates to a circuit arrangement for the generation of a bandgap reference voltage in CMOS technology, of the type that comprises using a circuit module for the generation of a base-emitter voltage difference comprising a pair of PNP bipolar substrate transistors.

Various embodiments may be applied to voltage references in DRAMs, flash memories, voltage regulators, and analog-to-digital converters.

BACKGROUND

In general, modules for generation of a voltage reference represent one of the most important analog modules in the development of analog or digital circuits such as DRAMs, flash memories, voltage regulators, analog-to-digital converters, and other circuits.

The majority of voltage references are designed on the basis of a bandgap voltage reference that produces a reference voltage of approximately 1.25 V, said bandgap reference voltage having a low dependence upon the temperature and/or the supply voltage.

A bandgap voltage reference operates on the basis of the principle of balancing in a circuit the negative temperature coefficient of a pn junction, usually the voltage $V_{BE}$ on the base-emitter junction of a bipolar transistor, with the positive temperature coefficient of the thermal voltage $V_T$, where $V_T$=kT/q.

The characteristics of bipolar transistors enable them, as mentioned, to supply the best defined quantities in order to obtain positive and negative temperature coefficients. The thermal voltage $V_T$ has a positive temperature coefficient of 0.085 mV/° C. at room temperature; i.e., it is a coefficient of a PTAT (Proportional To Absolute Temperature) electrical quantity, whether voltage or current. Instead, the base-emitter voltage $V_{BE}$ of a bipolar transistor has a negative temperature coefficient of approximately −2.2 mV/° C. at room temperature; i.e., it is a coefficient of a CTAT (Complementary To Absolute Temperature) electrical quantity.

In general, a bandgap voltage reference adds together two quantities, a PTAT one and a CTAT one, in particular two voltages, so as to obtain a voltage reference with zero temperature coefficient. This is obtained, in particular, by multiplying a multiple M of the thermal voltage $V_T$ and adding it to the base-emitter voltage $V_{BE}$, to obtain a reference voltage $V_{REF}=V_{BE}+MV_T$.

In CMOS technologies, where independent bipolar transistors are not available, to obtain the PTAT and CTAT quantities indicated above, parasitic bipolar transistors are exploited, in a way in itself known.

It is also possible, to obtain PTAT voltages, to use the difference between the gate-source voltages of two weakly reverse-biased MOS transistors.

In what follows, reference will be made in any case to solutions for generation of a bandgap voltage reference that use the parasitic PNP bipolar substrate transistors available in CMOS technology.

FIG. 12 represents in this connection the structure of a pMOSFET M, obtained in CMOS technology, which shows how the regions with p+ doping of the MOS structure, the region with n doping of the n-well, and the p substrate together identify a PNP bipolar transistor. The references E, B, and C designate the emitter, base, and collector electrodes, respectively.

FIG. 1 shows an example of bandgap-voltage-reference generator, designated by the reference number 50, which uses parasitic PNP bipolar substrate transistors to generate a base-emitter voltage.

The above generator 50 basically comprises a circuit module 101 for generation of a base-emitter voltage difference, which comprises a pair of transistors, a first bipolar transistor Q1, and a second bipolar transistor Q2. These bipolar transistors Q1 and Q2 are obtained from the parasitic PNP bipolar transistors available in CMOS technology, as shown in FIG. 12. For this reason, the parasitic bipolar transistors Q1 and Q2 have the collector and the base connected to ground and hence connected in common. The second bipolar transistor Q2 has an aspect ratio that is a number N times that of the first bipolar transistor Q1.

The emitter terminals E1 and E2 of the bipolar transistors Q1 and Q2 define, respectively, two branches, B1 and B2, that correspond to the paths of the currents I from the supply voltage Vdd to ground GND through the two respective transistors Q1 and Q2 that provide the base-emitter voltage drop on the above respective branches.

Connected to the emitter terminal E1 on the first branch B1 is a first resistance R2, whereas connected on the second branch B2, between the emitter E2 and the supply voltage Vdd, are a second resistance R1 for adjustment of the bandgap reference voltage and a bias resistance R3. Connected to the emitter E1 of the first bipolar transistor Q1 and to the node between the adjustment resistance R1 and the bias resistance R3 are the positive and negative terminals of a differential amplifier AMP, which supplies at output the reference voltage $V_{REF}$.

In this case, we have:

$$V_{REF}=V_{EB1}+(R2/R1)V_T\ln(N)$$

where $V_{EB1}$ is the voltage between the emitter and the base of the first bipolar transistor Q1. By operating on the ratio between the two adjustment resistances R2 and R1 and the value of the aspect ratio N, it is possible to vary the value of the bandgap reference voltage $V_{REF}$.

FIG. 2 shows a circuit arrangement of a bandgap-voltage-reference generator 100, in which, as compared to the generator 50 of FIG. 1, the operational amplifier has been eliminated, introducing a third branch B3, with a third path from the supply Vdd to ground GND, through a third bipolar transistor Q3 set in parallel with respect to the transistors Q1 and Q2 that constitute the so-called bipolar core 101 of a voltage-reference generator 101.

In what follows, reference will be made to CMOS current mirrors, and the diode-connected MOSFET, which provides the current-voltage conversion, will be referred to as the first MOSFET or first transistor of the current mirror, and the other MOSFET connected thereto via the gate, which provides the voltage-current conversion, will be referred to as the second MOSFET or transistor of the current mirror.

In this case, the circuit includes a first CMOS current mirror 102 of an n type, which comprises a first MOSFET M1, which, as has been said, is diode-connected, with its gate and drain electrodes shorted, and a second MOSFET M2, and is connected between the first branch B1 and the second branch B2, and a second CMOS current mirror 103 of a p type, which comprises a first MOSFET M4 and a second MOSFET M3 and is connected between the first branch B1 and the second branch B2. The first and second current mirrors, 102 and 103, are complementary and connected, through nodes D1 and D2 corresponding to the drains in common of their MOSFETs so that each repeats current mirror the current of the other.

Present on the third branch B3 is a further MOSFET M5, connected to the gate of the first MOSFET M4 of the second current mirror 103, which provides a further current mirror in parallel to the second current mirror 103, the output of which is connected through a second adjustment resistance R2 to the emitter E3 of the third bipolar transistor Q3, thus completing the third branch B3. The voltage reference $V_{REF}$ is taken between the further biasing transistor M5 and the second adjustment resistance R2.

It should be noted that, together with the adjustment resistance R1 that connects the emitter E2 on the second branch to the source of the transistor M2 of the first current mirror 102, these current mirrors 102 and 103 provide substantially the structure of a 'beta multiplier', where, however, the MOSFETs M1, M2, M3, M4 all have the same aspect ratio so that the current I2 in the second branch B2 is equal to the current I1 in the first branch B1. Since also the MOSFET M5 has the same aspect ratio as the MOSFET M4, also the current I3 in the third branch B3 is the same.

Also in this case we obtain a relation similar to the previous one:

$$V_{REF}=V_{EB3}+(R2/R1)V_T\cdot\ln(N)$$

where $V_{EB1}$ is the voltage between the emitter and the base of the third bipolar transistor Q3, while R2 is the adjustment resistance connected to the emitter E3 of the third bipolar transistor Q3, and R1 is the adjustment resistance connected to the emitter E2 of the transistor Q2.

Hence, in general, known circuits use further power-consumption sources, and further operational amplifiers or bipolar transistors in addition to the pair of bipolar transistors that supplies the base-emitter voltage difference, thus preventing any reduction of consumption of the bandgap-voltage-reference generator.

SUMMARY

There is a need in the art to improve the potential of the devices according to the known art as discussed previously.

Various embodiments address the foregoing need thanks to a circuit arrangement having the characteristics recited in the ensuing claims.

In one embodiment, it is envisaged that the circuit module for generation of a base-emitter voltage difference comprises only a first bipolar substrate transistor (inserted in the first circuit branch) and a second bipolar substrate transistor (inserted in the second circuit branch).

Various embodiments may envisage that the circuit arrangement includes a reference-voltage generation module comprising the second current mirror and the adjustment resistance and, connected on the first branch, a reference resistance set between the first and second current mirrors and an analog buffer, the input of which is connected to the reference resistance and to the second current mirror.

Various embodiments may envisage that the circuit arrangement includes an analog buffer that comprises a common-drain nMOS transistor on which the reference voltage is taken.

Various embodiments may envisage that the common-drain nMOS transistor has its output connected on the first branch on which the reference voltage is taken.

Various embodiments may envisage that the nMOS transistor has its output connected on the second branch on which the reference voltage is taken.

Various embodiments may envisage that the transistors of the first current mirror and the nMOS transistor operating as buffer that drives the reference voltage are sized so as to have the same drain-source voltage.

Various embodiments may envisage that the circuit arrangement comprises a further current mirror connected between the second current mirror and the reference-voltage generation module.

Various embodiments may envisage that the circuit arrangement includes a further current mirror of a p type with mirroring ratio of 1:2, comprising two diode-connected transistors arranged in parallel, which are connected to the second branch and to a further branch, while the other transistor of the current mirror, which has twice the aspect ratio, is connected to the first branch, the current mirror being connected on the first and second branches to an n-type current mirror with mirroring ratio of 2:1, which is connected in turn to said circuit module for generation of a base-emitter voltage difference, whereas on the further branch the current mirror is connected through a respective adjustment resistance to the circuit module for generation of a base-emitter voltage difference on the second branch.

BRIEF DESCRIPTION OF THE DRAWINGS

Various embodiments will now be described, purely by way of example, with reference to the annexed figures, wherein.

DETAILED DESCRIPTION

In the ensuing description, numerous specific details are provided to enable maximum understanding of the embodiments provided by way of example. The embodiments may be implemented with or without specific details, or else with other methods, components, materials, etc. In other circumstances, well-known structures, materials, or operations are not shown or described in detail so that aspects of the embodiments will not be obscured. Reference, in the course of this description, to "an embodiment" or "one embodiment" means that a particular feature, structure, or characteristic described in relation to the embodiment is comprised in at least one embodiment. Hence, phrases such as "in an embodiment", "in one embodiment", and the like that may be present in various points of this description do not necessarily refer to one and the same embodiment. Moreover, the particular features, structures, or characteristics may be combined in any convenient way in one or more embodiments.

The notation and references used herein are provided only for convenience of the reader and do not define the scope or the meaning of the embodiments.

Figure 3:
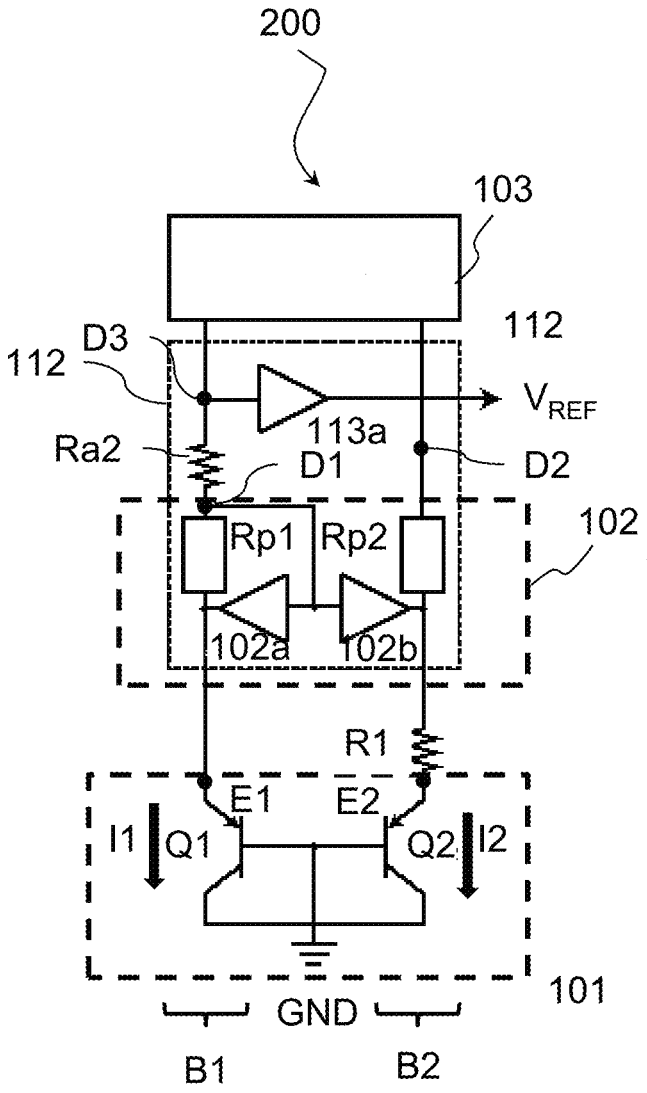
FIG. 3 shows a block diagram of a first embodiment of a circuit arrangement for generation of a voltage reference.

With reference to FIG. 3, a diagram of a first embodiment of a circuit arrangement 200 for the generation of a voltage reference is described.

Figure 1:
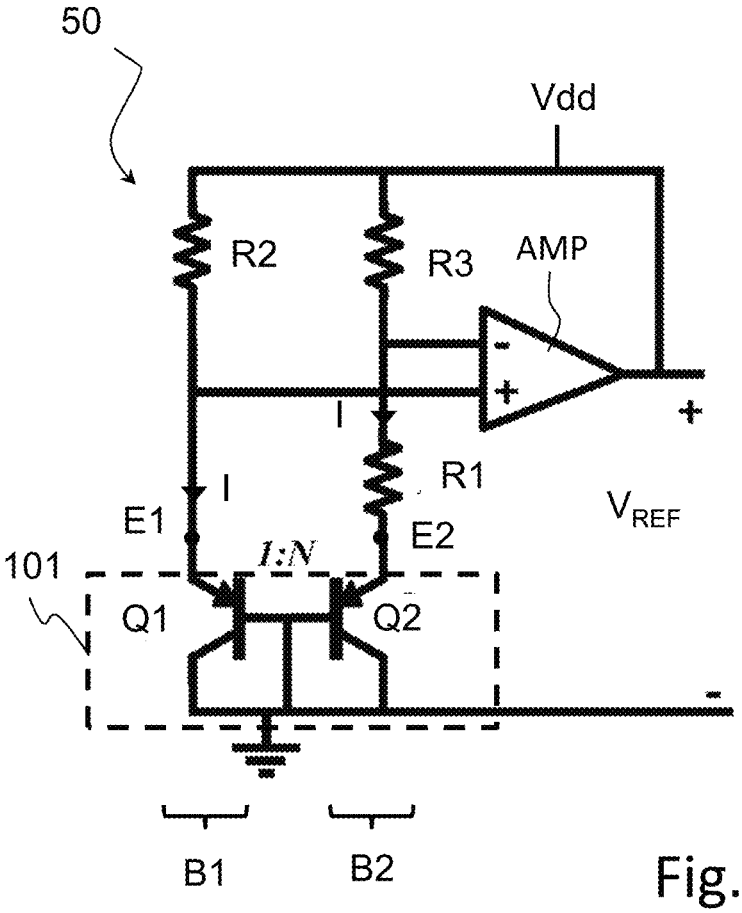
Fig. 1 (Prior Art)
FIGS. 1, 2, and 12 have already been described previously.
Figure 12:
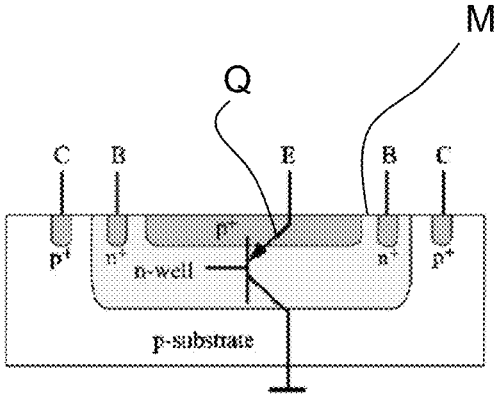
Fig. 12 (Prior Art)

Designated by the reference 101 is the circuit module for generation of a base-emitter voltage difference, which comprises a pair of parasitic substrate transistors Q1 and Q2 of a PNP type, with the base in common and the collector connected to ground, as already described with reference to the generators of FIGS. 1 and 2, so as to define, respectively, a first branch B1 and a second branch B2, corresponding to current paths between the supply Vdd and ground GND.

The circuit arrangement 200 comprises, connected to the above circuit module 101 for generation of a base-emitter voltage difference, in particular to the emitter terminals or nodes E1 and E2, a reference-voltage generation circuit module 112.

Figure 2:
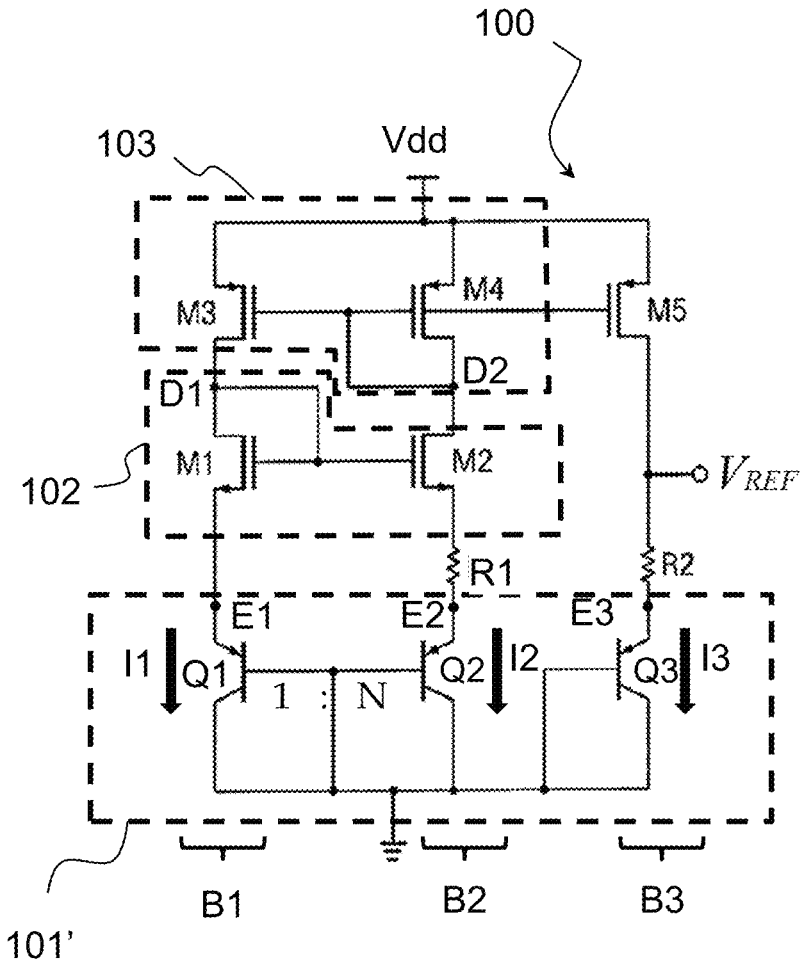
Fig. 2 (Prior Art)

The above reference-voltage generation module 112 comprises a block 102 that carries out current mirroring, which may be considered equivalent (but for the possible insertion of bias resistances Rp1 and Rp2) to the first current mirror 102 of FIG. 2, and (with reference also to the embodiment described in FIGS. 4, 6, and 9) is arranged in the same way, connected to the emitter terminals E1 and E2 via the sources of the MOSFETs M1 (first MOSFET of the first mirror 102) and M2 (second MOSFET of the first mirror 102). FIG. 3 shows that these MOSFETs M1 and M2 identify voltage buffers 102*a* and 102*b*. As described in what follows, these buffers are implemented as common-drain voltage buffers. These buffers 102*a* and 102*b*, the outputs of which are connected to the branches B1 and B2, have bias resistances Rp1 and Rp2 the value of which can be set in order to shift the working point of the circuit. Moreover, the circuit 200 also comprises the second current mirror 103 of a p type of FIG. 2, connected in the same way to the branches B1 and B2.

The reference-voltage generation module 112, however, further comprises, on a node D1 corresponding to the first current mirror 102, i.e., the drain of the transistor M1, a reference-adjustment resistance Ra2, connected to which is the input of an analog voltage buffer 113*a*. The reference voltage $V_{REF}$ is taken at the output of said analog buffer 113*a*.

As a result of the introduction of the above reference-adjustment resistance Ra2 and analog buffer 113*a*, the node D1 of FIG. 2, which was common to the drains of the transistors M1 and M3, is now divided into two nodes, D1 and D3, on the first branch B1, set between which is the reference-adjustment resistance Ra2. On the second branch B2, between the two current mirrors 102 and 103, no elements are, instead, introduced. Consequently, the drains of the MOSFETs M2 and M4 are in common in a node D2, in the diagram of FIG. 3 and in the implementations of FIGS. 4 and 5. This does not take into account the bias resistances Rp1 and Rp2, which enable optimization the working point of the circuit.

In this circuit arrangement 200, the reference voltage is $$V_{REF} \cong V_{EB1} + V_{R2} = V_{EB1} + Ra2 \cdot I1 \cong V_{EB1} + (Ra2/R1) \cdot V_T \cdot \ln(N)$$

where $V_{R2}$ is the voltage drop across the reference-adjustment resistance Ra2, and I1 is the current that flows in the transistor Q1, as likewise in the transistor Q2, i.e., in the two branches 1, 2 of the circuit; namely, I1=I2=I. It should be noted that the voltage drop on the bias resistances Rp1, Rp2 does not come into play for the purposes of definition of the reference voltage $V_{REF}$. In fact, with reference to the circuit of FIG. 3, it is assumed that the drop on the voltage buffers 102*a*, 102*b* is zero (i.e., that they are ideal buffers). The voltage at the node D3 (which is hence the reference voltage $V_{REF}$) is the sum of the drop on the adjustment resistance Ra2, the drop on the first buffer 102*a* (which is zero), and the potential of the emitter node E1, i.e., $V_{EB1}$. N is the ratio between the aspect ratios of the second transistor Q2 and the first transistor Q1. R1 is the other adjustment resistance, as it was already in FIG. 2. Basically, the adjustment resistance Ra2 on the first branch B1, as has been seen, replaces the second adjustment resistance R2 on the third branch B3 of FIG. 2.

In this way, the circuit arrangement 200 uses just the consumption of current I determined by the module 101, which comprises just two branches, B1 and B2, and hence just two bipolar transistors Q1 and Q2, to generate the bandgap voltage reference $V_{REF}$, without any need to add any other current consumption.

In other words, the circuit arrangement 200 has a circuit module 101 for generation of a base-emitter voltage difference, which comprises just the first bipolar substrate transistor Q1 inserted in the first circuit branch B1 and the second bipolar substrate transistor Q2 inserted in the second circuit branch B2, the current that flows in the circuit arrangement 200 (from the supply voltage Vdd to ground GND) flowing only through the first bipolar substrate transistor Q1 and the second bipolar substrate transistor Q2.

The circuit arrangement 200 is obtained in CMOS technology, and hence the bipolar transistors Q1 and Q2 are obtained as parasitic PNP transistors. As has been seen, the known solutions, such as the one illustrated in FIG. 2, normally use three or more branches, whereas the solution described herein uses just two branches, B1 and B2, thus reducing current consumption.

Figure 4:
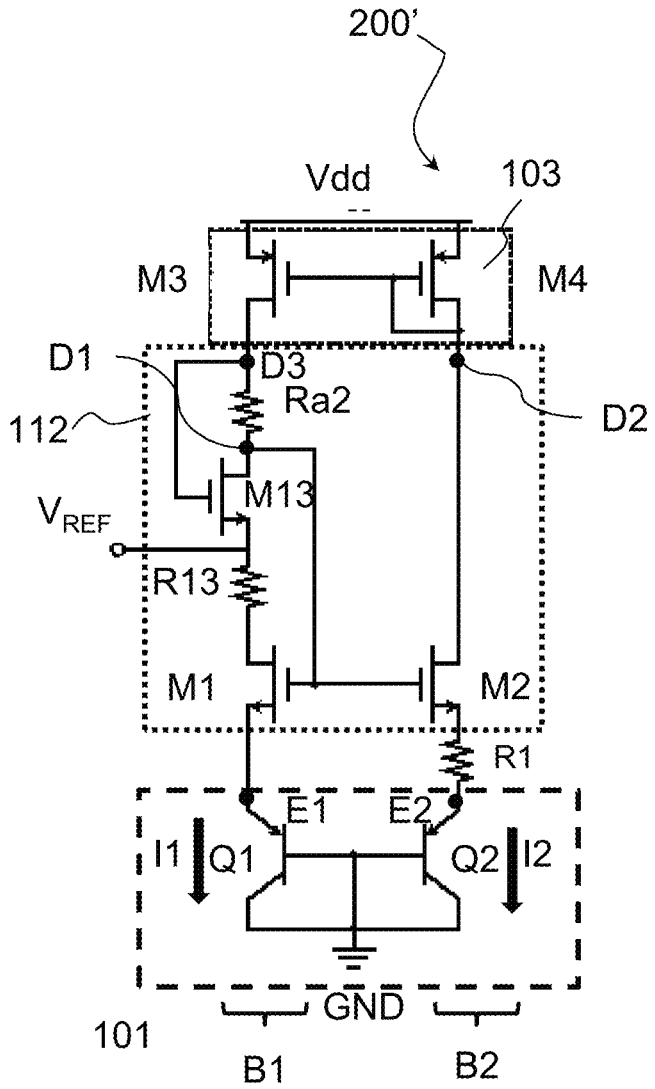
FIG. 4 shows in detail an embodiment of the circuit arrangement of FIG. 3.

FIG. 4 shows a circuit implementation 200' of the embodiment of FIG. 3. The first buffer 102*a* is obtained via the nMOS transistor M1, while the second buffer 102*b* is obtained via the second nMOS transistor M2. The p-type current mirror 103 is obtained, as in FIG. 2, via two pMOS transistors, the first MOSFET M4 and the second MOSFET M3, which are connected via their sources to the digital supply voltage Vdd and have their drains connected to the terminals D3 and D2, respectively.

The third buffer 113*a* is obtained via a third MOSFET M13 of an n type, the gate of which is connected to the resistance Ra2 and to the node D3, which is the drain node of the MOS M3 of the second current mirror 103, i.e., on the first branch B1. The drain of the MOS M13 is connected to the other end of the reference-adjustment resistance Ra2, i.e., to the node D1, and is shorted on the gates of the transistors M1 and M2 of the first current mirror 102. Hence, this MOS M13 has at input (i.e., at its gate) the voltage on the terminal at higher potential of the resistance Ra2, and at output (i.e., at its source) it drives the reference voltage $V_{REF}$. The source of the MOSFET M13, on which the output $V_{REF}$ is taken, is connected via a source resistance R13 to the drain of the first MOSFET M1 of the mirror 102 on the first branch B1. Consequently, the MOS M13 operates substantially as analog buffer, in particular a common-drain voltage buffer with output on the source.

In this case, ensuring for example, by sizing the resistance R13, as described in greater detail hereinafter, that the drain-source voltage $V_{DS1}$ of the first MOSFET M1 is approximately equal to the drain-source voltage $V_{DS13}$ of the MOSFET M13 that implements the buffer 113*a*, the reference voltage $V_{REF}$ is $$V_{REF}=-V_{GS13}+V_{R2}+V_{GS1}+V_{EB1}\cong V_{EB1}+V_{R2}=V_{EB1}+Ra2\cdot I_{D1,D3}$$

where $V_{GS13}$ and $V_{GS1}$ are the gate-source voltages of the transistors M13 and M1, and $I_{D1,D3}$ is the current that flows in their drains, i.e., the current I1 in the first branch B1.

The resistance R13 between the source of the third MOSFET M13 and the drain of the first MOSFET M1 serves for proper operation of the circuit, in so far as it has the purpose of rendering the drain-source voltage $V_{DS1}$ of the first nMOS M1 of the mirror 102) equal to the drain-source voltage VDS13 of the MOS M13. In fact, given two nMOS transistors traversed by the same current and with the same aspect ratio W/L, it is necessary to render also their drain-source voltages $V_{DS}$ equal for them to have the very same gate-source voltage $V_{GS}$ (given that by rendering the voltages $V_{DS}$ equal, the effect of modulation of the channel length is made equal). It hence be noted that $$V_{DS13}(M13)=-Ra2\cdot I+V_{GSM13}$$

while $$V_{DS1}=-R13\cdot I-V_{GS13}+Ra2\cdot I+V_{GS1}$$

i.e., $V_{DS1}=-R13\cdot I+Ra2\cdot I$

Then, by fixing R13 so that $$R13=2\cdot Ra2-V_{GS}/I$$

we have $$V_{GS13}=V_{GS1}$$

Rendering equal the gate-source voltages $V_{GS}$ makes it possible to obtain the relation $$V_{REF}=-V_{GS13}+V_{R2}+V_{GS1}+V_{EB1}\cong V_{EB1}+V_{R2}$$

appearing above.

If moreover the circuit is sized in such a way that the drain-source voltage $V_{DS1}$ of the first MOSFET M1 of the current mirror 102 on the first branch B1 is approximately equal to the drain-source voltage of the second MOSFET M2 of the current mirror 102 on the second branch B2, the approximate equality $$V_{REF}\cong V_{EB1}+(Ra2/R1)\cdot V_T\cdot\ln(N)$$

is obtained with an even higher precision, and in this way the precision with which the reference voltage $V_{REF}$ is fixed increases.

Figure 5:
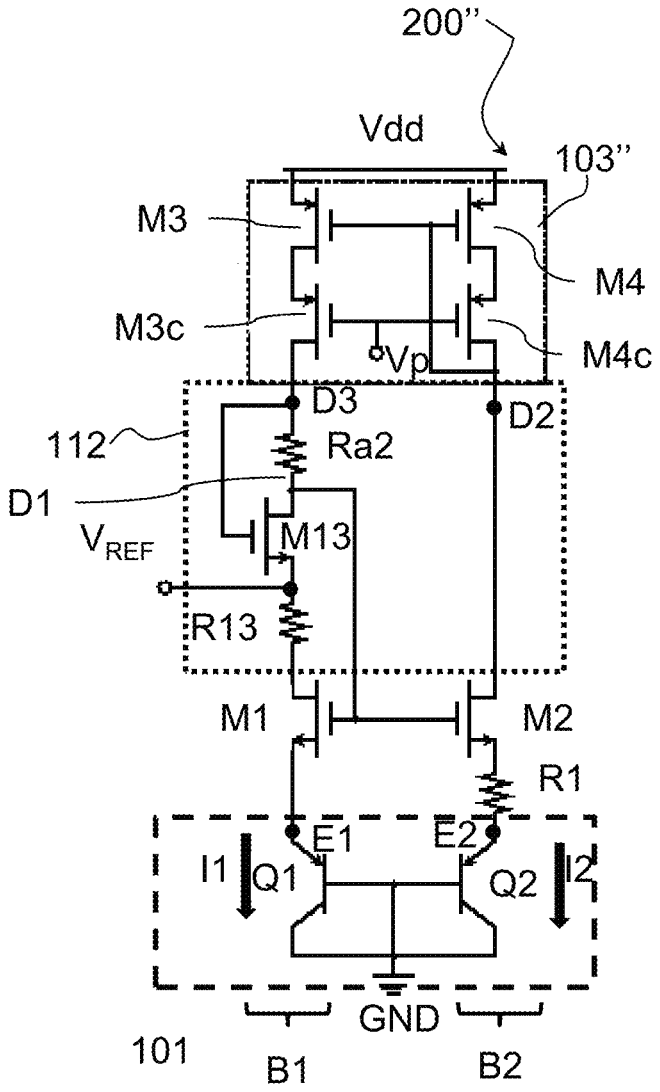
FIG. 5 shows a variant of the circuit arrangement of FIG. 4.

FIG. 5 shows a variant of the circuit arrangement of bandgap-voltage-reference generator 200" where a current mirror 103" in cascode configuration is used, in which it is possible to optimize the maximum output dynamics thanks to adjustment of a biasing voltage level $V_p$. This mirroring configuration is in itself known. In the implementation described, the current mirror 103" comprises the pair of MOSFETs M3, M4 and further respective MOSFETs M3*c* and M4*c* set cascoded thereto. This arrangement increases the power-supply rejection (PSR) factor of the circuit, and moreover increases the precision with which the currents that flow on the two branches B1 and B2 are rendered equal to one another. It should be noted that by increasing the precision with which the currents on the two branches B1 and B2 are rendered equal, the precision with which the reference voltage is determined is further increased $$V_{REF}=-V_{GS13}+V_{R2}+V_{GS1}+V_{EB1}=V_{EB1}+V_{R2}=V_{EB1}+Ra\cdot I_{D1,D3}.$$

In this case, the gates of the MOSFETs M3 and M4 are shorted on the node D3 to provide the diode configuration on the second branch B2, while connected to the gates of the further pair of transistors M3*a*, M4*a* is the biasing voltage $V_p$ of the cascode. The voltage level $V_p$ is a voltage level that, during the design stage, is optimized in order to maximize the output dynamic of the mirror 103". An appropriate setting of the value of biasing voltage $V_p$ renders the mirror 103" equivalent to the mirror 103 of FIG. 4 from the standpoint of the dynamics (i.e., in other words, the maximum value of voltage at the node D3 is Vdd−$V_{SDsat3}$ and the maximum value at the node D2 is Vdd−$V_{SG4}$ both for the mirror 103 and for the mirror 103"). Generation of the level of biasing voltage $V_p$ would require insertion of a further current branch: this additional current branch in practice may be characterized by a current consumption that is in any case a negligible fraction of the currents that flow in the two main branches. Hence, even by generating the level of biasing voltage $V_p$, the total consumption is approximately the one necessary in the two main branches.

Also in the implementations proposed in FIGS. 4 and 5, the voltage drop on the bias resistances $R_{p1}$ and $R_{p2}$ does not come into play for the purposes of definition of the reference voltage $V_{REF}$, even though the drop of the voltage buffers 102*a*, 102*b*, 113*a* implemented via the MOSFETs M1, M2, M13 is not zero, but corresponds to the gate-source voltage $V_{GS}$ of the MOS. However, in all cases, by following the path that goes from the reference voltage $V_{REF}$ to the emitter-base voltage $V_{EB}$ of the bipolar transistors Q1 and Q2, it may be noted that we obtain (with reference to the embodiments of FIGS. 4,5,6,7, and 8)

$$V_{REF}=[-V_{GS13}+V_{R2}+V_{GS1}+V_{EB1}]$$

where $V_{GS13}$ corresponds to the gate-source voltage of the MOS M13, and $V_{GS1}$ to the gate-source voltage of the MOS M1. Considering that these MOSFETs M13 and M1 are traversed by the same current, it follows that their gate-source voltages are equal and hence cancel out in the relation appearing above.

In various embodiments, in the circuit implementations 200' there may possibly be added a further bias resistance between the node D2 and the drain of the MOS M2. Thanks to this further resistance, it is possible to fix to a precise value also the drain-source voltage $V_{DS}$ of the MOS M2. In fact, operation of the circuit is improved if also the second MOSFET M2 of the mirror 102 has (in addition to the same current) the same drain-source voltage $V_{DS}$ (and obviously the same aspect ratio W/L) as the MOSFETs M1 and M3: by so doing, in fact, the voltages at the source of the first MOSFET M1 and at the source of the second MOSFET M2 are rendered equal with a high precision, and the biasing current is set at the value $$(V_{EB1}-V_{EB})/R1=(V_T\cdot\ln(N))/R1$$

with a high precision.

In this way, the reference voltage $V_{REF}$ is fixed with a greater precision.

If this further resistance between the node D2 and the drain of the MOS M2 is zero, i.e., is not present, we have $$V_{DS2}=Vdd-V_{SG4}-V_{EB1}$$

If the value of supply voltage Vdd is high to the point of causing the drain-source voltage $V_{DS2}$ of the second MOSFET M2 to be higher than the drain-source voltage $V_{DS1}$ of the first MOSFET M1, which is equal to the drain-source voltage $V_{DS3}$ of the third MOSFET M13, an improvement in performance may be obtained by inserting a value of said further bias resistance between the node D2 and the drain of the MOS M2 other than zero. If this resistance is denoted by R14, we thus have:

$$V_{DS2}=Vdd-R14\cdot I-V_{SG4}-V_{EB1}$$

and hence the resistance R14 must be fixed to impose $$V_{DS1}=V_{DS2}=V_{DS3}$$

Figure 6:
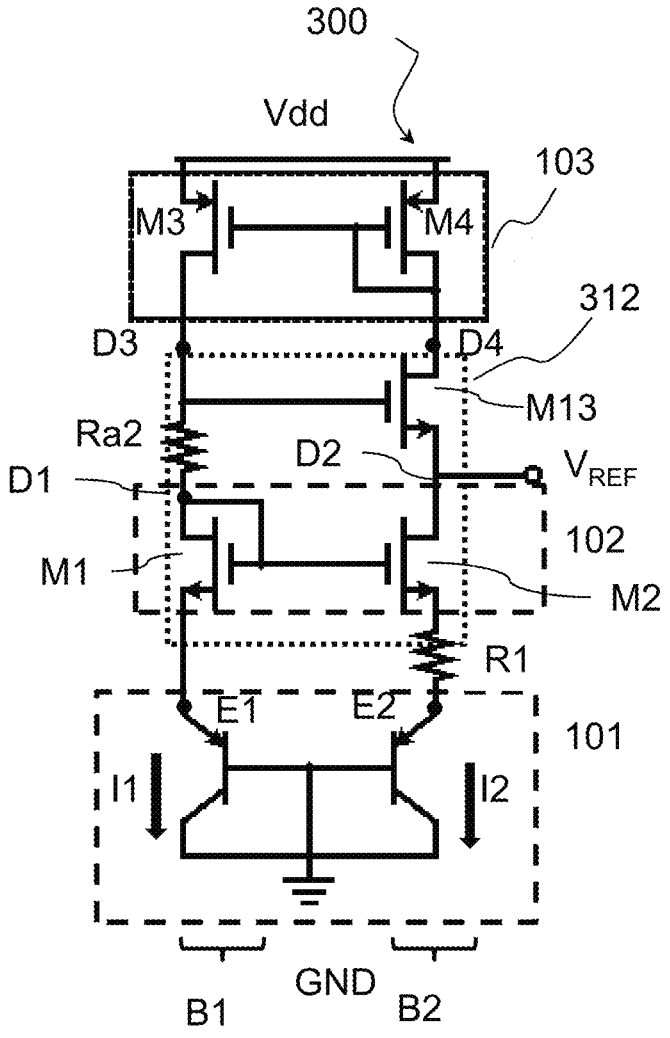
FIG. 6 shows in detail a second embodiment of the circuit arrangement of FIG. 3.

FIG. 6 shows a second implementation 300 of the first embodiment of FIG. 3.

This implementation corresponds to that of FIG. 4; in particular, it has a similar circuit module 101 for generation of a base-emitter voltage difference and a similar second current mirror 103 connected to the supply voltage Vdd. The reference-voltage generation module 312 comprises in the same way the first current mirror 102. In addition, the drain node D1 of the first MOSFET M1 of the mirror 102 and the drain node D3 of the second MOSFET M3 of the mirror 103 are also in this case separated by the reference-adjustment resistance Ra2. The difference of the reference-voltage generation module 312 from the module 112 of FIG. 4 is that the MOSFET M13 that implements the voltage buffer 113*a* is in this case located on the second branch B2, i.e., set between the drain D4 of the diode-connected transistor M4 of the second mirror 103, to which it is connected via its own drain, and the drain D2 of the second transistor of the first current mirror, to which it is connected via its own source. The gate of the transistor M13 remains connected at the node D2 to a terminal of the reference resistance Ra2, as in FIG. 4. In this case, the resistance R13 is not present.

Considering that the current $I_{D1}$ in the drain of the first diode-connected MOSFET M1 on the first branch B1 is approximately equal to the current $I_{D2,D4}$ in the drains D2, D4 of the transistors M2 and M13 on the second branch B2, by ensuring via sizing that the drain-source voltage $V_{DS1}$ of the first MOSFET M1 is approximately equal to the drain-source voltage $V_{DS13}$ of the third MOSFET M13, then the reference voltage $V_{REF}$ is $$V_{REF}=-V_{GS13}+V_{R2}+V_{GS1}+V_{EB1}=V_{EB1}+V_{R2}=V_{EB1}+Ra2\cdot I_{D1}$$

If moreover the circuit is sized in such a way that the drain-source voltage of the first MOSFET M1, $V_{DS1}$, is approximately equal to the drain-source voltage of the second MOSFET M2 on the second branch B2, then also in this case the precision with which the reference voltage $V_{REF}$ is determined is maximized.

Also in this case the module 101 has just two branches, B1 and B2, i.e., just two current paths from the supply to ground, for the just two bipolar transistors Q1 and Q2.

Figure 7:
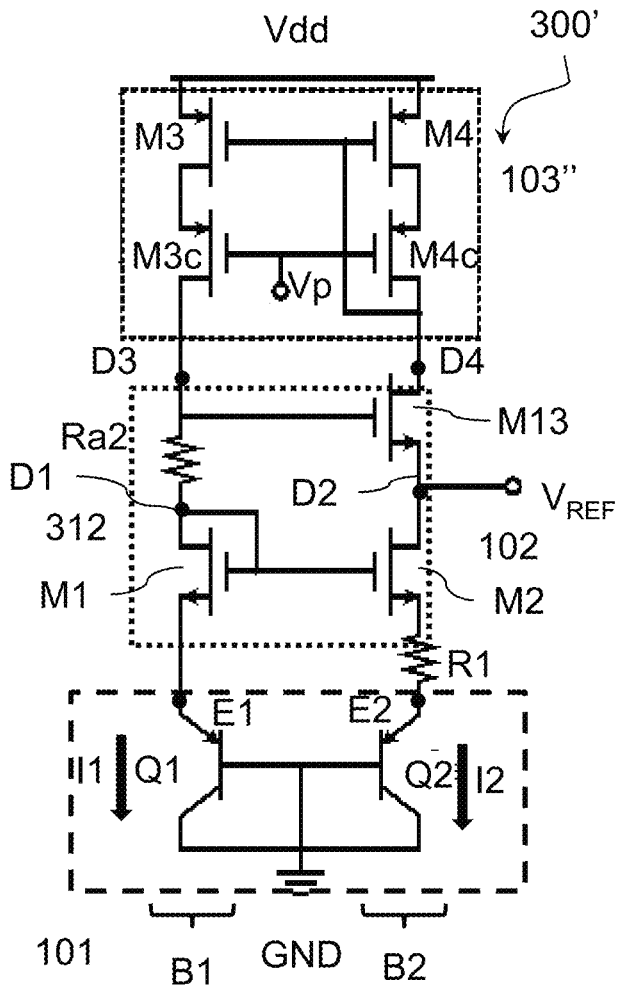
FIG. 7 shows a variant of the circuit arrangement of FIG. 6.

FIG. 7, in a way similar to FIG. 5, shows a variant 300' of the circuit of FIG. 6 in which a current mirror 103' in cascode configuration is used (which comprises the pair of MOSFETs M4 (diode-connected) and M3, and additional respective MOSFETs M4*a* and M3*a* cascaded thereto. In this case, the gates of the MOSFETs M3 and M4 are shorted on the node D2 to provide the diode configuration on the second branch B2, whereas the gates of the further pair of MOSFETs M4*a*, M3*a* are connected to a biasing voltage $V_p$, to which there also apply the same considerations set forth previously regarding the mirror 103".

Figure 8:
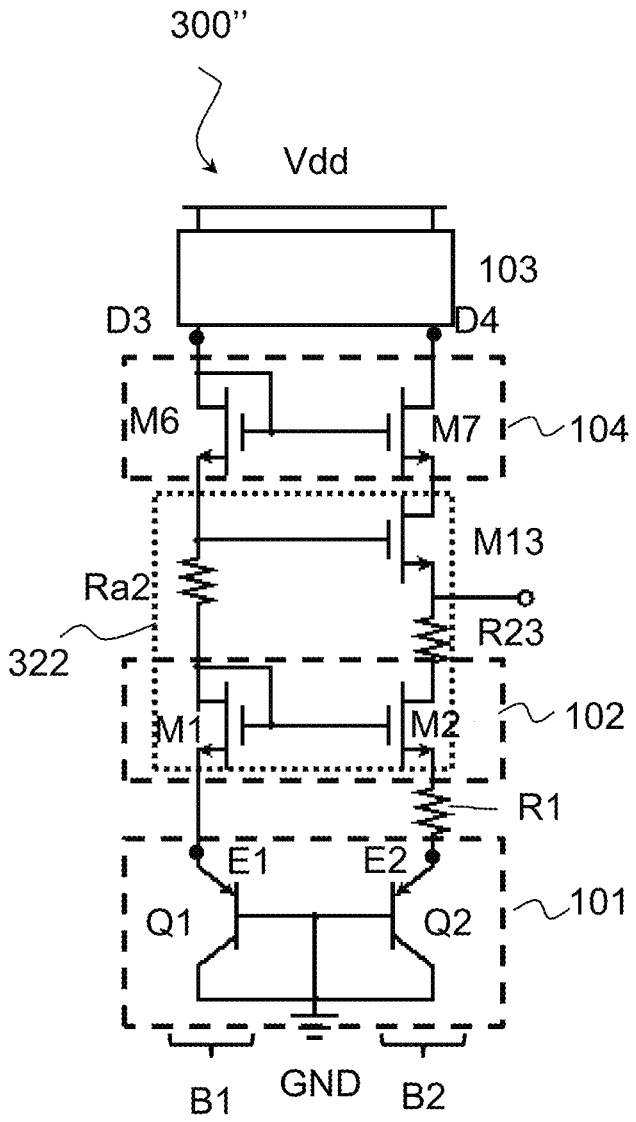
FIG. 8 shows a second variant of the circuit arrangement of FIG. 6.

FIG. 8 shows a further variant 300" of the circuit of FIG. 6, which makes it possible to obtain drain-source voltages for the MOSFETs M1, M2, M3 that are exactly equal, in this way guaranteeing a better precision of the reference voltage $V_{REF}$.

In this case, set between the second current mirror 103 and a reference-voltage generation module 322 is a third current mirror 104, with an n-type MOSFET, where the MOSFET M6 on the first branch B1 is diode-connected with the drain connected to the node D3, whereas set on the second branch is the second MOSFET M7 with the drain connected to the node D4.

The reference-voltage generation module 322 corresponds to the module 312 of FIG. 6 or FIG. 7, except for the fact that a resistance R23 is set between the source of the transistor M13 that operates as analog buffer, on which the reference voltage $V_{REF}$ is taken, and the drain of the second transistor M2 of the first current mirror 102.

The MOSFETs M6 and M7 of the third current mirror 104 ensure that $V_{DS1}=V_{DS13}$, whereas the resistance R23 is a resistance the value of which can be sized greater than zero in order to render equal to zero also the drain-gate voltage of the MOS M2 (in the case where this is positive). Hence, it is possible to obtain $V_{DS2}=V_{DS1}$ via the resistance R23, thus rendering the drain-source voltages of M2, M1 and M13 equal, by sizing $$R23=(V_{Ra2}-V_{GS1,2,13})/I_{D1,D2,D3}$$

The circuit of FIG. 6, instead, without the further current mirror with MOSFETs M6 and M7, determines a lower value for the minimum supply voltage Vdd admissible.

Figure 9:
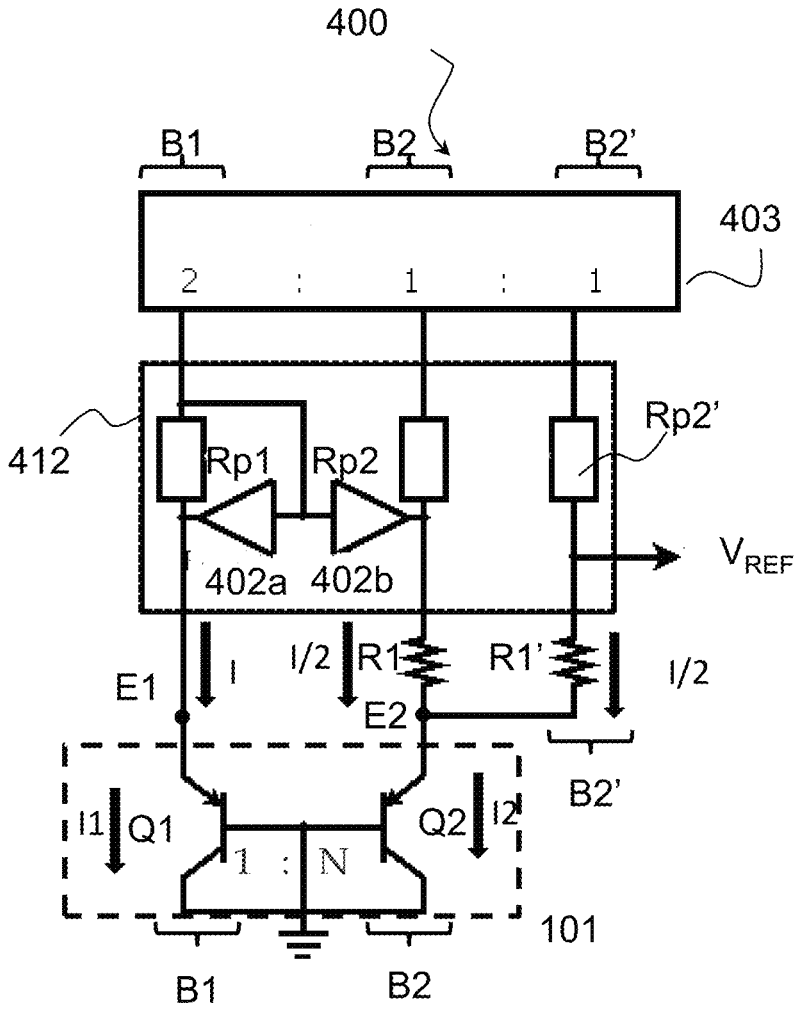
FIG. 9 shows a block diagram of a second embodiment of a circuit arrangement for generation of a voltage reference.

FIG. 9 shows a block diagram of a second embodiment 400 of a circuit arrangement for the generation of a voltage reference.

As may be noted this embodiment comprises the circuit module 101 for generation of a base-emitter voltage difference already described with reference to FIG. 3 and comprising a pair of parasitic substrate transistors Q1 and Q2 of a PNP type, with the base in common and the collector at ground and a resistive load on the emitter of the second transistor Q2.

In this case, however, from the emitter nodes E1 and E2 to the supply, the other modules of the circuit 400 have three branches, the second branch B2 being split into two via the addition in parallel of a further branch B2', connected between the supply voltage Vdd and the emitter of the second bipolar transistor. In particular, connected to the supply Vdd is a p-type current mirror 403 with a mirroring ratio of 2:1:1 on the branches B1, B2 and B2', respectively; namely, the current on the second branch B2 and on the further branch B2' is half of the current I1 (or I) on the first branch.

A reference-voltage generation module 412 comprises a current mirror of an n type, 402, connected to the branches B1 and B2, which has also a mirroring ratio of 2:1, comprising buffers 402*a* and 402*b*. Each of the buffers 402*a* and 402 has a bias resistance Rp1 and Rp2. Moreover, provided on the further branch B2' is a third bias resistance Rp2' that connects the second current mirror 403, through an adjustment resistance R1', to the emitter E2.

Figure 10:
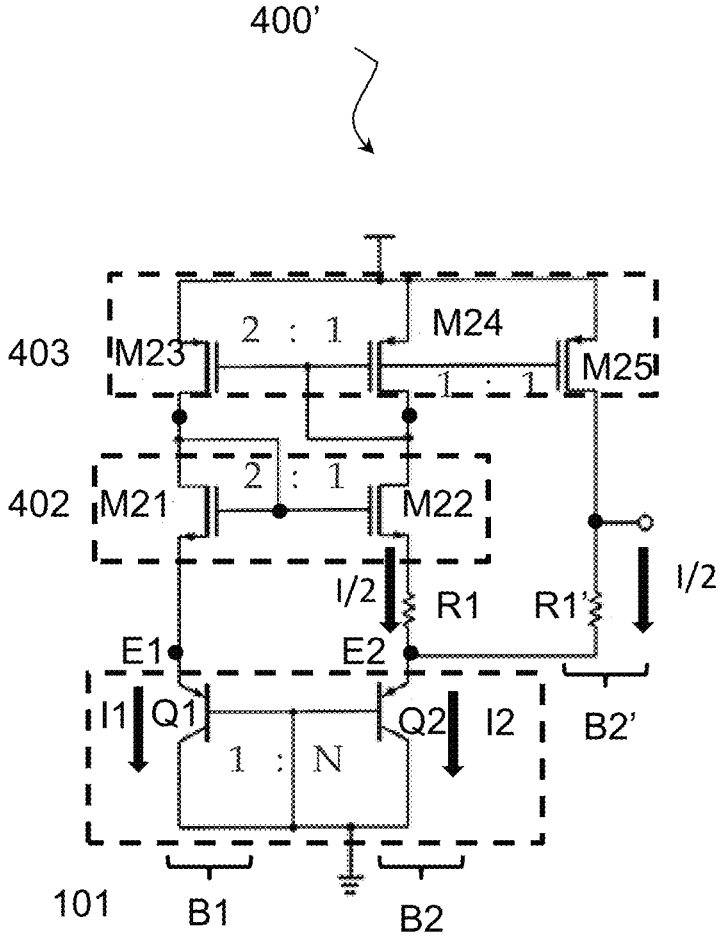
FIG. 10 shows in detail an embodiment of the circuit arrangement of FIG. 9.

FIG. 10 shows a circuit implementation 500, where the p-type current mirror 403 comprises a second MOSFET M23 on the first branch B1 with aspect ratio that is twice that of the first MOSFETs M24 and M25 connected in parallel on the branches B2 and B2'. Likewise, the current mirror 402 implements the buffers 402*a* and 402*b* via MOSFETs M21 and M22, where the first MOSFET M21 on the first branch B1 has an aspect ratio that is twice that of the MOSFET M22 on the second branch B2. In this way, a current I1 is determined that is twice the currents through the transistors M24 and M25, so that in the second branch B2 there once again flows a current I2 equal to I1, at the same time maintaining just two branches, B1 and B2, at the level of the generation module 101 and as far as ground GND.

The output $V_{REF}$ is taken on the further branch B2' between the drain node of the transistor M25 and the further adjustment resistance R1' connected to the emitter E2 of the bipolar transistor Q2 in parallel to the adjustment resistance R1.

Hence, also in this case, hence, the bandgap voltage $V_{REF}$ is $$V_{REF} \cong V_{EB1,2} + V_{R1'} + V_{EB1,2} + R1' \cdot I/2 \cong V_{EB1,2} + (R1'/R1) \cdot V_T \cdot \ln(N)$$

The adjustment ratio in this case depends upon the two adjustment resistances R1 and R1' connected in parallel to the emitter E2 of the second bipolar transistor Q2.

Figure 11:
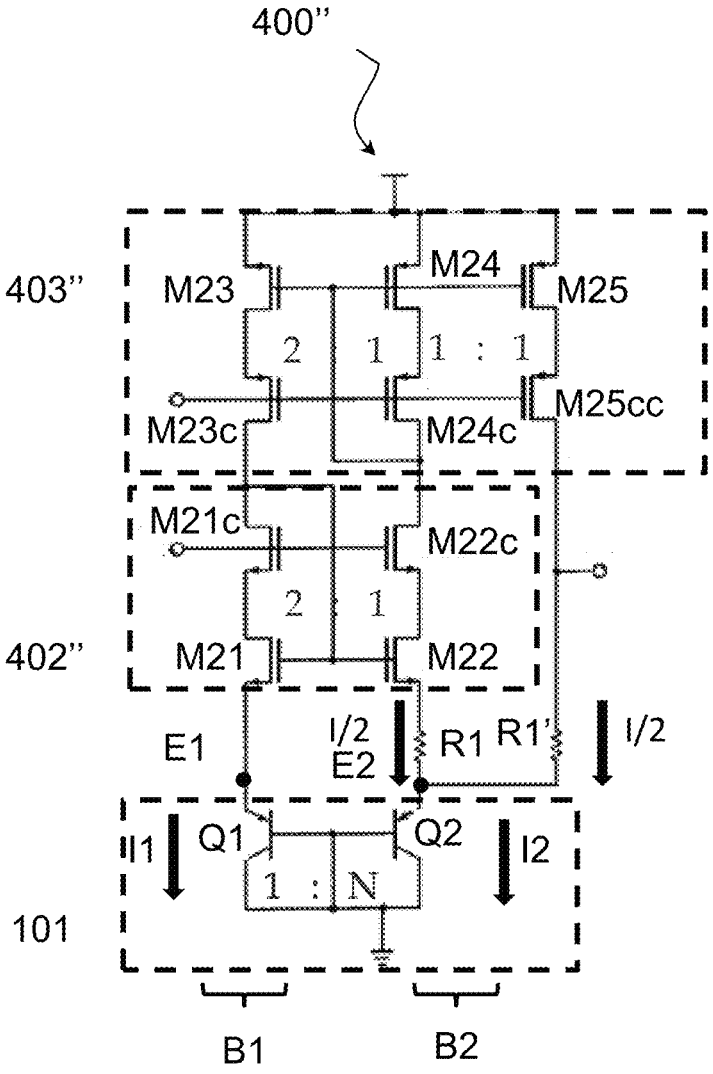
FIG. 11 shows a variant of the circuit arrangement of FIG. 10.

FIG. 11, in a way similar to FIG. 7, shows a variant 400" of the circuit of FIG. 10 where all the MOSFETs are in cascode configuration, including the MOSFETs M21 and M22 that identify the buffers 402*a* and 402*b*. A first biasing voltage $V_{p1}$ is supplied to the further MOSFETs (M23*c*, M24*c*, M25*c*) of the current mirror 403', and a second biasing voltage $V_{p2}$ is supplied to the further MOSFETs M21*c* and M22*c* that implement the n-type current mirror 402'.

Hence, from the description the advantages of the solution described emerge clearly.

The circuit arrangement described enables a low consumption to be obtained in the generation of a bandgap reference voltage with CMOS technology, with a reduction of current consumption of approximately 33%, via a circuit that comprises only two current paths between the supply and ground in the module for generation of the base-emitter voltage, without the use, however, of operational amplifiers for supplying the reference voltage at output.

The reduction of current consumption is particularly important in so far as reference-voltage generation circuits are one of the most important modules for design of analog and digital circuits such as DRAMs, flash memories, voltage regulators, analog-to-digital converters, etc.

Of course, without prejudice to the principle of the solution described, the details and the embodiments may vary, even considerably, with respect to what has been described herein purely by way of example, without thereby departing from the sphere of protection of the present invention, which is defined by the annexed claims.

The invention claimed is:

1. A circuit arrangement, comprising:

a circuit module configured to generate a base-emitter voltage difference comprising at least one pair of PNP bipolar substrate transistors that includes a first bipolar substrate transistor inserted in a first circuit branch which identifies a first current path from a supply voltage to ground and a second bipolar substrate transistor inserted in a second circuit branch which identifies a second current path from the supply voltage to ground, said first and second bipolar substrate transistors being connected together via their base electrode, and the second bipolar substrate transistor having an aspect ratio higher than that of the first bipolar substrate transistor;

a first current mirror of an n type connected between said first branch and said second branch and connected to the second bipolar substrate transistor via a first resistor configured to adjust a bandgap voltage reference;

a second current mirror of a p type connected between said first branch and said second branch;

a second resistor connected in said first branch between the first and second current mirrors with a first terminal coupled to the first current mirror and a second terminal coupled to the second current mirror;

wherein said first current mirror and second current mirror are connected so that each current mirror repeats the current of the other current mirror;

wherein said circuit module comprises said first bipolar substrate transistor inserted in the first circuit branch and said second bipolar substrate transistor inserted in the second circuit branch;

wherein all current that flows in said circuit arrangement from the supply voltage to ground flows into a ground node through said first bipolar substrate transistor and said second bipolar substrate transistor.

2. The circuit arrangement according to claim 1, further comprising: an analog buffer having an input connected to the second terminal of said second resistor and an output connected in the second branch between the first current mirror and the second current mirror.

3. The circuit arrangement according to claim 2, wherein said analog buffer comprises a common-drain nMOS transistor having a gate connected to the second terminal of the second resistor, a drain connected to the second current mirror in the second branch and a source connected to the first current mirror in the second branch.

4. The circuit arrangement according to claim 3, wherein the bandgap voltage reference is output from the source of said common-drain nMOS transistor.

5. The circuit arrangement according to claim 3, wherein transistors of the first current mirror and the common-drain nMOS transistor are sized so as to have the same drain-source voltage.

6. The circuit arrangement according to claim 3, further comprising a further current mirror connected between the second current mirror and the common-drain nMOS transistor.

7. The circuit arrangement according to claim 1, wherein said first current mirror and second current mirror are of a cascoded type.

8. A bandgap circuit, comprising:

a first current path including circuit components that are coupled in series with each other from a first reference supply node to a second reference supply node in the following order: a first bipolar transistor, then a first MOS transistor, then a first resistor, and then a second MOS transistor;

wherein a drain of the first MOS transistor is connected to one terminal of the first resistor; and a second current path including further circuit components that are coupled in series with each other from the first reference supply node to the second reference supply node in the following order: a second bipolar transistor, then a second resistor, then a third MOS transistor, then a fourth MOS transistor, and then a fifth MOS transistor;

wherein the first and third MOS transistors are connected in a first current mirror configuration;

wherein a gate of the fourth MOS transistor is connected to another terminal of the first resistor; and wherein the second and fifth MOS transistors are connected in a second current mirror configuration.

9. The bandgap circuit of claim 8, wherein the second current mirror configuration further comprises sixth and seventh MOS transistors coupled as cascode transistors, respectively, to the second and fifth MOS transistors.

10. The bandgap circuit of claim 9, further comprising, coupled in series between the first reference supply node and the second bipolar transistor: an eighth MOS transistor; a ninth MOS transistor coupled in series with the eighth MOS transistor; and a third resistor coupled in series with the ninth MOS transistor; wherein the eighth MOS transistor is connected in a third current mirror configuration with the second and fifth MOS transistors; and wherein the ninth MOS transistor is connected in a fourth current mirror configuration with the cascode transistors.

11. The bandgap circuit of claim 10, wherein a bandgap reference voltage is output at a terminal of the third resistor.

12. The bandgap circuit of claim 8, further comprising, coupled in series between the first reference supply node and the second bipolar transistor: an eighth MOS transistor; and a third resistor coupled in series with the eighth MOS transistor; wherein the eighth MOS transistor is connected in a third current mirror configuration with the second and fifth MOS transistors.

13. The bandgap circuit of claim 12, wherein a bandgap reference voltage is output at a terminal of the third resistor.

14. The bandgap circuit of claim 8, wherein a bandgap reference voltage is output at a terminal between the third and fourth MOS transistors.

15. The bandgap circuit of claim 8, further comprising a third resistor coupled in series between the third and fourth MOS transistors.

16. The bandgap circuit of claim 15, wherein a bandgap reference voltage is output at a terminal of the third resistor.

17. A bandgap circuit, comprising:

a first reference supply node;

a second reference supply node;

a first current path comprising a first bipolar transistor having a collector connected to the first reference supply node, a first MOS transistor having a source connected to an emitter of the first bipolar transistor, a first resistor having a first terminal connected to a drain of the first MOS transistor, and a second MOS transistor coupled between a second terminal of the first resistor and the second reference supply node;

a second current path comprising a second bipolar transistor having a collector connected to the first reference supply node, a second resistor having a first terminal connected to an emitter of the second bipolar transistor, a third MOS transistor having a source connected to a second terminal of the second resistor, a fourth MOS transistor having a source connected to a drain of the third MOS transistor and a gate connected to the second terminal of the first resistor, and a fifth MOS transistor coupled between a drain of the fourth MOS transistor and the second reference supply node;

wherein the first and third MOS transistors are coupled in a first current mirroring configuration; and wherein the second and fifth MOS transistors are coupled in a second current mirroring configuration.

18. The bandgap circuit of claim 17, further comprising:

a sixth MOS transistor coupled in cascode with the second MOS transistor; and a seventh MOS transistor coupled in cascode with the fifth MOS transistor.

19. The bandgap circuit of claim 17, further comprising:

a sixth MOS transistor coupled in series with the second MOS transistor; and a seventh MOS transistor coupled in series with the fifth MOS transistor;

wherein the sixth and seventh MOS transistors are coupled in a third current mirroring configuration.

20. The bandgap circuit of claim 17, further comprising a third resistor having a first terminal connected to the drain of the third MOS transistor and a second terminal connected to the source of the fourth MOS transistor.

21. The bandgap circuit of claim 20, wherein a bandgap reference voltage is output at the second terminal of the third resistor.

22. The bandgap circuit of claim 17, wherein a bandgap reference voltage is output at a terminal formed by the drain of the third MOS transistor and the source of the fourth MOS transistor.

* * * * *